US006279162B1

(12) United States Patent
Silverthorn

(10) Patent No.: US 6,279,162 B1
(45) Date of Patent: Aug. 28, 2001

(54) SAFETY PROTECTION GARMENT

(76) Inventor: Scott Silverthorn, 35480 Purcell Pl., Fremont, CA (US) 94536

( * ) Notice: Subject to any disclaimer, the term of this patent is extended or adjusted under 35 U.S.C. 154(b) by 0 days.

(21) Appl. No.: 09/753,538

(22) Filed: Jan. 2, 2001

(51) Int. Cl.[7] ..... A41D 1/02; B63C 9/06

(52) U.S. Cl. ..... 2/108; 2/97; 2/DIG. 3; 441/87

(58) Field of Search ..... 2/85, 456–458, 2/2.11, 2.14, 102, 93, 97, 108, DIG. 1, DIG. 3, DIG. 10; 441/87, 88, 102, 106, 107, 108, 113, 122

(56) References Cited

U.S. PATENT DOCUMENTS

| | | | | |
|---|---|---|---|---|
| 3,995,320 | | 12/1976 | Zafuto . | |
| 4,089,065 | | 5/1978 | McGee . | |
| 4,310,927 | | 1/1982 | DeBose . | |
| 4,416,641 | | 11/1983 | Spinosa et al. . | |
| 4,453,271 | | 6/1984 | Donzis . | |
| 4,626,221 | | 12/1986 | Rocco . | |
| 4,637,074 | | 1/1987 | Taheri . | |
| 5,255,390 | * | 10/1993 | Gross et al. | 2/456 |
| 5,466,179 | | 11/1995 | Jeffrey, Sr. . | |
| 5,584,737 | * | 12/1996 | Luhtala | 441/107 |
| 5,813,891 | | 9/1998 | McNamee . | |
| 5,860,162 | | 1/1999 | Love . | |
| 5,867,842 | | 2/1999 | Pinsley et al. . | |
| 6,128,784 | * | 10/2000 | Frank | 2/102 |
| 6,206,744 | * | 3/2001 | Wigutow | 441/88 |

* cited by examiner

*Primary Examiner*—John J. Calvert
*Assistant Examiner*—Tejash Patel
(74) *Attorney, Agent, or Firm*—Richard E. Backus

(57) ABSTRACT

A safety protection garment which enables a user to comfortably wear it during travel, and in which the garment can be rapidly prepared for an emergency for resisting impact forces or for providing buoyancy to keep the user afloat in water. The garment has an inner lining and outer shell which are joined together to form a chamber which contains a compressible layer. The compressible layer is formed of an elastic material which resiliently expands and contracts between memory and compressed shapes. A valve device enables the user to open and close air flow into the chamber. For normal wearing, the layer is in its compressed state with air substantially evacuated from the chamber and the valve closed. To prepare for an emergency, the valve is opened so that air enters the chamber sufficient to equalize the chamber pressure with atmospheric pressure. The layer then expands to its memory shape where it resiliently resists impact forces and also provide buoyancy to keep the user afloat in water.

12 Claims, 3 Drawing Sheets

SAFETY PROTECTION GARMENT

BACKGROUND OF THE INVENTION

1. Field of the Invention

This invention relates in general to safety protection garments, and more particularly to jackets and other garments providing impact protection during emergencies in travel on airplanes and other modes of transportation, as well as buoyancy during over-water emergencies.

2. Description of the Related Art

Inflatable floatation and life preserver vests and other garments have been provided in the prior art. Certain of the designs are activated during emergencies by connecting inflatable bladders with a source of compressed air or $C0_2$. Inflatable life vests have been provided in which the user blows air through an oral valve into the vest. Life vests and belts have also been provided which are inflatable when compressed gas is directed into the belt through a valve which is either manually triggered or responsive to immersion of the belt in water.

Prior art belts of the type described have a number of disadvantages, and limitations. First, they are relatively bulky and uncomfortable to wear such that travelers on airplanes, for example, normally do not wear the vest until emergencies arise. In many cases a crash, and resulting injury, can occur without there being time for the life vest to be located and put on the user. Second, even when the life vests or belts are worn they tend to restrict the range of the user's arm movements and in general limits mobility. Third, many of the designs depend upon releasing a source of pressurized gas, such as from a $CO_2$ cylinder or reaction of chemical components, which typically are carried on the vest. The gas source must be replaced for reuse of the life vest.

The need has therefore been recognized for a safety protection garment which obviates the foregoing limitations and disadvantages or prior art safety garments. Despite the various such safety garments in the prior art, there has heretofore not been provided a suitable and attractive solution to these problems.

OBJECTS AND SUMMARY OF THE INVENTION

The invention provides a safety protection garment comprising a compressible layer which is fitted within a chamber formed between an inner lining and outer shell of the garment. A valve arrangement is provided for controlling the flow of a gas such as air to and from the chamber. For normal wearing, gas is substantially expelled from the chamber so that the force of atmospheric pressure pressing from outside the lining and shell cause the compressible layer to contract to a compressed state. This enables the user to wear the garment in a normal manner. When an emergency arises, the valve is opened by the user to enable passage of air into the chamber. Elastic memory of the compressible layer causes it to expand towards its memory shape until the chamber returns to atmospheric pressure. In the memory shape, the compressible layer has sufficient resiliency to resist impact forces on the garment. Also in the memory shape, the compressible layer has sufficient buoyancy in water for keeping the garment and user afloat.

The foregoing and additional objects and features of the invention will appear from the following description of the invention taken in conjunction with the accompanying drawings.

DESCRIPTION OF THE PREFERRED EMBODIMENTS

Figure 1:
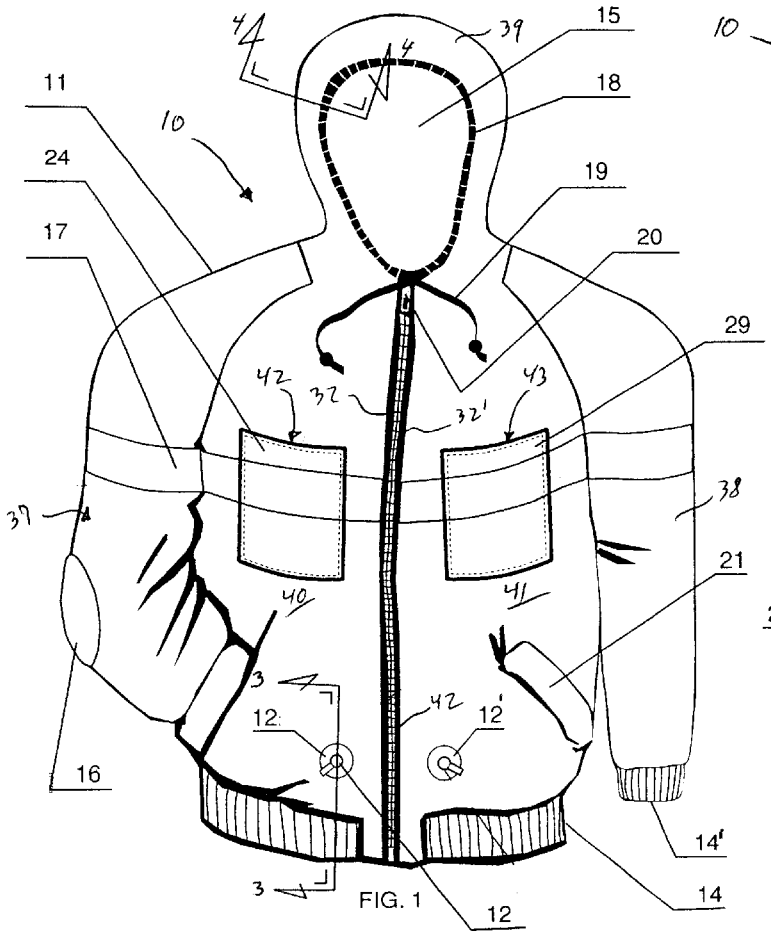
FIG. 1 is a front elevation view of a safety protection garment in accordance with one embodiment of the invention.
Figure 2:
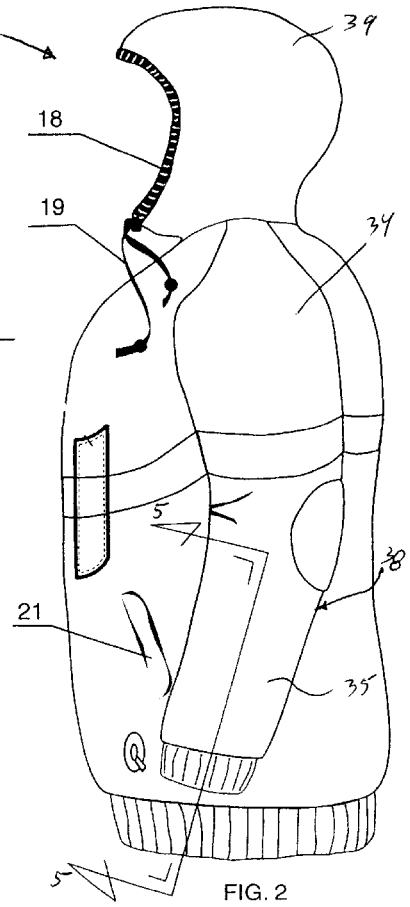
FIG. 2 is a side elevation view of the garment of FIG. 1.

In the drawings, a safety protection garment in accordance with one preferred embodiment is illustrated generally at 10. Garment 10 is configured in the shape of a hooded jacket, and the invention contemplates use of other forms of garments, such as coats or vests.

Garment 10 is comprised of an outer shell 11 which overlies an inner lining 15. The outer shell can be comprised of an inner lining 15. The outer shell can be comprised of a suitable fire retardant heavy-duty nylon.

The inner lining can be of a suitable fire retardant heavy-duty double sided polyester/cotton material. Preferably the outer shell is brightly colored for high visibility, such as when afloat on water.

The front of garment 10 is formed with left and right front portions 40, 41 (as viewed in FIG. 1) which are releasably joined together along an upright parting line by suitable means such as a zipper 42. The jacket has a pair of sleeves 37, 38 for enclosing the user's arms, and the lower ends of the sleeve are provided with elastic cuffs 14'. The lower ends of the sleeve lining and shell are joined together along with cuff 14' with a line of stitching 13" (FIG. 5), which preferably comprises a fire retardant heavy-duty nylon thread. An elastic waistband 14 is also provided at the lower end of the jacket body. The lower margins of the lining and shell are joined together with the waistband by a line of water tight stitching 13' (FIG. 3), which preferably is a fire retardant heavy-duty nylon thread. Elbow pads 16 can be secured as by sewing to the elbow areas of the sleeves.

Figure 4:
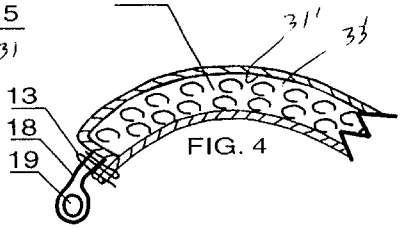
FIG. 4 is a fragmentary sectional view, to an enlarged scale, taken along the line 4—4 of FIG. 1.

A hood 39 extends upwardly from the jacket body. A front opening in the hood is provided with an elastic band 18 and hood drawstring 19 for tight fitting about the user's face. The outer margins of the shell and lining are joined together with band 18 by a line of water tight stitching 13 (FIG. 4), preferably of a suitable fire retardant heavy-duty nylon thread. Polyester/cotton lined pockets 21 are formed in left and right front portions of the jacket for hand warming. A band or strip 17 of suitable light reflecting material can be placed horizontally around the upper portion of the jacket for increasing visibility during an emergency.

Figure 5:
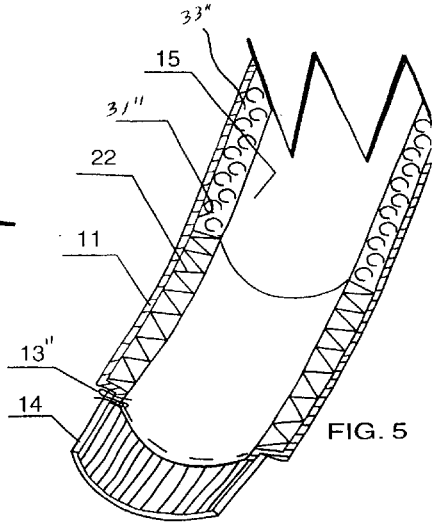
FIG. 5 is a fragmentary sectional view, to an enlarged scale, taken along the line 5—5 of FIG. 2.

The shell 11 and lining 15 are formed in segments having margins which are joined together to define chambers 31 (FIG. 3), 31' (FIG. 4) and 31" (FIG. 5). For example, margins 32 and 32' of the respective left front and right front (as viewed in FIG. 1) of the shell are joined with corresponding margins of a lining behind them to form sealed edges of the chambers for the left and right front portions. Within each of these chambers, compressible layers 33, 33' and 33" are fitted.

The compressible layers 33, 33' and 33" are formed of a suitable elastic material which resiliently expands and contracts between a memory shape and a compressed state. The elastic material can be comprised of a polymer embedded with a plurality of gas cells, such as a foam polymer, which preferably is fire retardant.

Each arm sleeve of garment 10 is formed with an upper segment 34 extending just above the person's elbow and a lower segment 35. As best shown in FIG. 5, the upper segment 34 has the compressible layer 33" sandwiched between the outer shell and inner lining. The lower segment 35 has no compressible layer but instead has a fire retardant padding 22 in the chamber between the outer shell and inner lining. The padding can be made of a suitable fire retardant heavy-duty polyester with sufficient flexibility to allow for arm movement.

Figure 3:
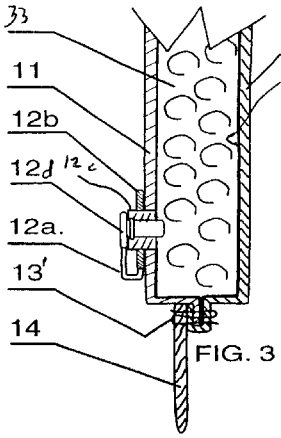
FIG. 3 is a fragmentary sectional view, to an enlarged scale, taken along the line 3—3 of FIG. 1.
Figure 6:
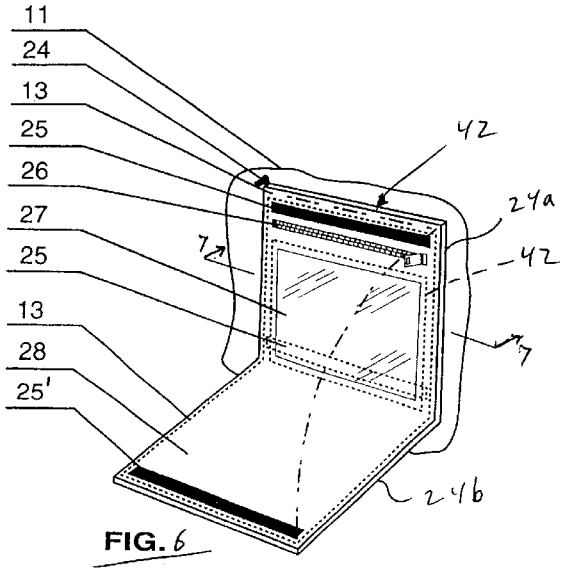
FIG. 6 is a partial isometric view, to an enlarged scale, of one of the pockets of the garment shown in FIG. 1.
Figure 8:
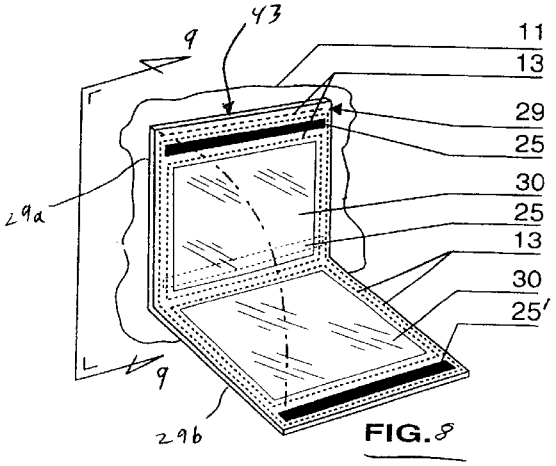
FIG. 8 is a partial isometric view, to an enlarged scale, of another one of the pockets of the garment shown in FIG. 1.
Figure 7:
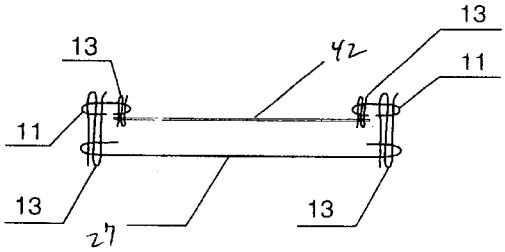
FIG. 7 is a cross-sectional view, to an enlarged scale, taken along the line 7—7 of FIG. 6.
Figure 9:
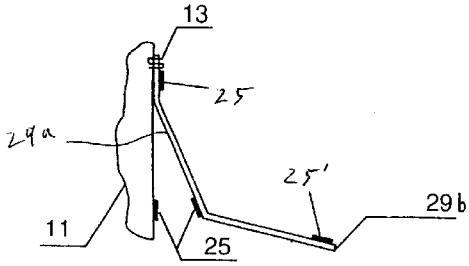
FIG. 9 is a side view, to an enlarged scale, taken along the line 9—9 of FIG. 8.
Figure 10:
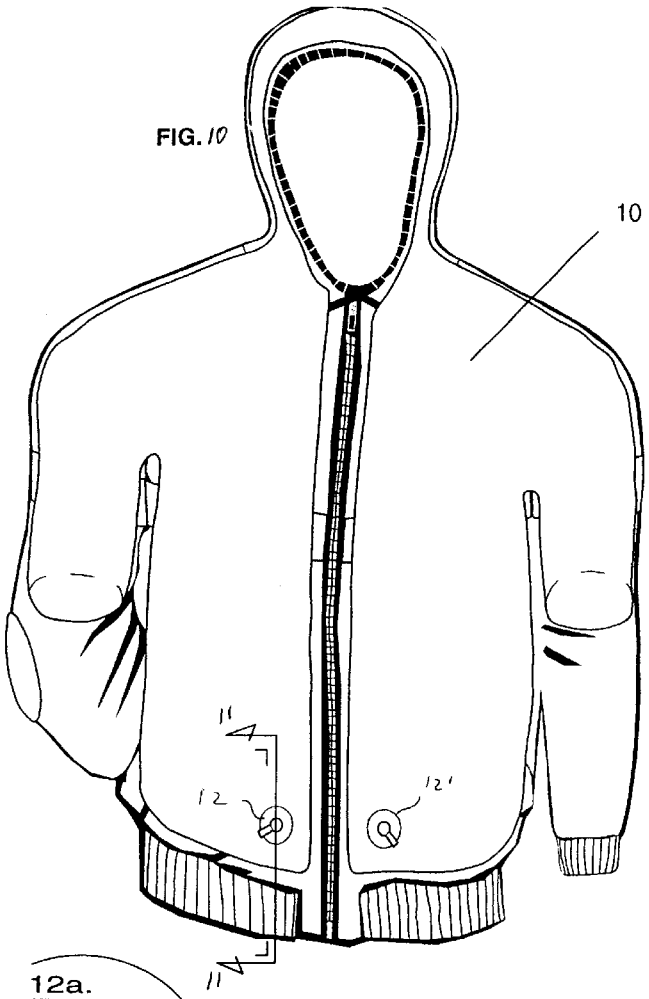
FIG. 10 is a front elevation view of a garment in accordance with another embodiment.
Figure 13:
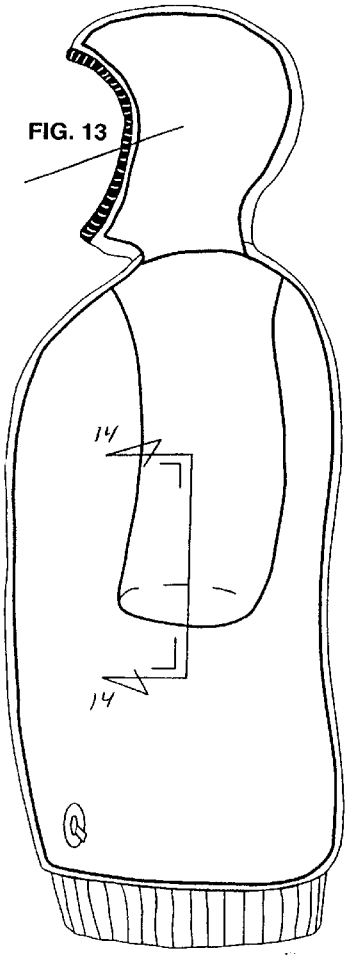
FIG. 13 is a side elevation view of the garment of FIG. 10.
Figure 12:
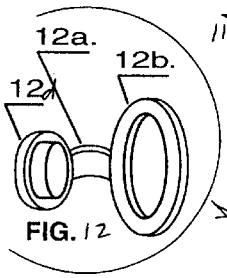
FIG. 12 is an isometric view, to an enlarged scale, of the valve device shown in FIG. 11.

In the jacket, the left and right front portions (as viewed in FIG. 1) are provided with respective valve devices 12 and 12'. Each valve device selectively enables ingress and egress of air or other gas into and from the chamber 31. As best shown in FIG. 3, valve 12 is comprised of a flexible web 12*a* having a proximal end 12*b* connected around an annular valve body 12*c* and a distal end 12*d* which is formed with a plug that releasably fits within the valve body. The user can grasp and pull plug 12*d* out for allowing air to enter into the chamber, and the plug can be placed back in after air is evacuated from the chamber. A light pocket 42 and mirror pocket 43 are secured as by sewing to the respective left and right front portions of the garment. As best illustrated in FIG. 6, light pocket 42 comprises a base 24 having a proximal portion 24*a* secured as by stitching 13 to the outer shell of the garment, and a fold-out portion 24*b* which is flexibly joined to the lower end of the base portion. Matching Velcro strips 25 and 25' are secured to ends of the base for releasably holding the fold-out portion in an upright position. A zipper 26 is provided for insertion and removal of a suitable light emitter 42, such as an LED sheet. A soft plastic cover 27 is secured as by stitching to cover the opening through which the LED sheet is exposed.

The mirror pocket 29 on the right side (when viewed in FIG. 1) provides a reflective signal mirror 30. The pocket 29 is comprised of a base 29*a* that is secured as by stitching 13 to the garment's outer shell, together with a fold-out flap 29*b*. Matching Velcro strips 25 and 25' are provided for releasably holding flap 25' in an upright closed position. The mirror 30 comprises a plastic sheet having its front face formed with a reflective surface mounted behind an opening in base 29*a*. A line of stitching 13 around the perimeter of the opening holds the mirror in place.

Figure 11:
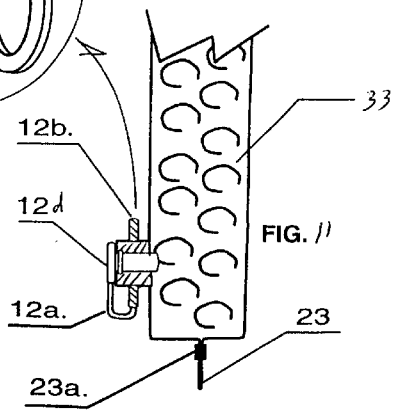
FIG. 11 is a fragmentary sectional view, to an enlarged scale, taken along the line 11—11 of FIG. 10.
Figure 14:
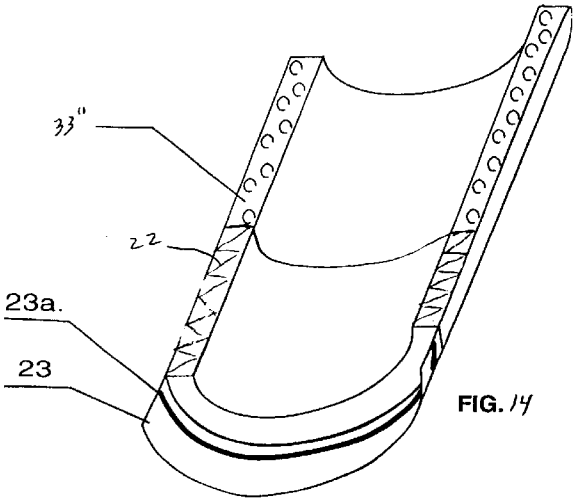
FIG. 14 is a partial isometric sectional view, to an enlarged scale, taken along the line 14—14 of FIG. 13.

FIGS. 10–14 illustrate details in the construction of garment 10. As shown in FIG. 11, the lower marginal edges of the outer shell and inner lining are joined together by heat seal strip 23*a* which extends along the flap 23. This heat seal strip allows for stitching with the waistband shown in FIG. 3. FIG. 14 shows a heat seal strip 23*a* or flap 23 for allowing stitching with cuff 14' of FIG. 5. This form of heat seal strip is typical throughout the garment for joining other portions of the shell and lining together.

In use of the invention, the user can comfortably wear garment 10 throughout normal travel activities, such as sitting in an airplane seat. In order to prepare the garment for this, each of the valves 12 are opened and the garment is laid on a flat surface. It is then folded and rolled tightly from one end. This compresses layer 32 and squeezes substantially all the air out of chamber 31. Both valves are then closed, and atmospheric pressure will force the shell and lining against the compressed layer 32. The garment can then be worn in the usual manner.

When an emergency arises during travel, such as when the plane nears a water landing, the user can prepare by pulling the hood over his or her head, drawing the zipper all the way up, and tying the drawstring so that the elastic face band fits tight against the face area. Both air valves are then opened permitting ingress of air into the chambers. The equalization of the chamber pressure with atmospheric pressure enables the compressible layer to expand back to its memory shape. In this memory state, the layer has sufficient resiliency to yieldably resist impact forces applied to the garment, such as when the aircraft strikes the water. Should it be necessary for the user to evacuate the aircraft into the water, then the volume of the expanded garment creates sufficient buoyancy so that the user can remain afloat.

When the user is in the water, or where the aircraft comes down on land, pocket 43 can be opened so as to use reflective signal mirror 30, e.g., by reflecting sunlight up to search and rescue aircraft. In twilight or dark situations, pocket 42 can be opened so as to enable activation of the LED signal light.

While the foregoing embodiments are at present considered to be preferred, it is understood that numerous variations and modifications may be made therein by those skilled in the art, and all such variations and modifications are deemed to be within the scope of the invention as set forth in the appended claims.

What is claimed is:

1. A safety protection garment comprising an inner lining which is shaped and sized suitable for wearing by a user, an outer shell positioned over a portion of the inner lining, the lining and shell having portions which are joined together and which define a chamber between the lining and shell, a compressible layer fitted within the chamber, the layer being formed of an elastic material which resiliently expands and contracts between a memory shape and a compressed shape, the layer being expandable to the memory shape responsive to gas pressure within the chamber being substantially equalized with atmospheric pressure, the layer being contractible to the compressed shape responsive to the atmospheric pressure being greater than the gas pressure within the chamber, the layer in its memory shape having sufficient resiliency to yieldably resist impact forces applied externally to the garment, and a valve device for selectively enabling ingress and egress of gas into and from the chamber.

2. A garment as in claim 1 in which the elastic material is comprised of a polymer embedded with a plurality of gas cells.

3. A garment as in claim 2 in which the elastic material is a foam polymer.

4. A garment as in claim 1 in which the valve device is selectively operable between closed and open positions, the valve in its closed position preventing ingress of air into the chamber to maintain said compressed shape of the layer, and the valve in its open position permitting ingress of air into the chamber to enable said outward expansion of the layer.

5. A garment as in claim 1 which comprises a jacket having a pair of sleeves for enclosing the user's arms, the sleeves each having upper and lower segments, each upper segment comprising portions of the layer which are fitted between portions of the lining and shell, and each lower segment comprising portions of the lining and shell which are devoid of the compressible layer for enabling substantially unimpeded movement of lower portions of the arms.

6. A garment as in claim 1 in which the lining and shell are each comprised of flame retardant materials.

7. A garment as in claim 1 in which the jacket is further comprised of a pocket on the outer shell, and a signaling device within the pocket.

8. A garment as in claim 7 in which the signaling device is selected from the group consisting of a light reflective mirror and a light emitter.

9. A garment as in claim 1 in which the compressible layer is water impervious to provide sufficient buoyancy in water for keeping the garment and user afloat.

10. A garment as in claim 1 and further comprising a band of light reflective material affixed to the outer shell.

11. A garment as in claim 1 which comprises a jacket having left and right front portions releasably joined together along an upright parting line, the compressible layer comprises first and second segments within respective left and right front portions, and the valve device comprises first and second valves carried on respective left and right front portions for enabling ingress and egress of gas into and from respective first and second segments of the compressible layer.

12. A garment as in claim 11 in which the jacket comprises a hood for fitting around a portion of the user[1]s head.

* * * * *